United States Patent [19]

Horlacher et al.

[11] Patent Number: 4,466,900

[45] Date of Patent: Aug. 21, 1984

[54] PROCESS FOR THE PREPARATION OF FLUORESCENT BRIGHTENER FORMULATIONS WHICH ARE STABLE ON STORAGE

[75] Inventors: Paul Horlacher, Möhlin; Heinz Pfenninger, Lupsingen, both of Switzerland

[73] Assignee: Ciba-Geigy Corporation, Ardsley, N.Y.

[21] Appl. No.: 417,233

[22] Filed: Sep. 13, 1982

[30] Foreign Application Priority Data

Sep. 22, 1981 [CH] Switzerland ..... 6105/81

[51] Int. Cl.[3] ..... C09K 11/06

[52] U.S. Cl. ..... 252/301.23; 252/301.21; 252/301.22; 252/301.25; 252/301.26; 252/301.27; 252/301.28; 252/301.32

[58] Field of Search ..... 252/301.23, 301.21, 252/301.27, 301.22, 301.26, 301.25, 301.28, 301.32

[56] References Cited

U.S. PATENT DOCUMENTS 4,247,401 1/1981 Bloch et al. ..... 210/638

FOREIGN PATENT DOCUMENTS 26399 9/1980 European Pat. Off. ..... 252/301.24

2204725 1/1973 Fed. Rep. of Germany ..... 252/301.24

2805891 8/1979 Fed. Rep. of Germany ..... 252/301.24

1359898 7/1974 United Kingdom ..... 252/301.24

2015018 7/1978 United Kingdom .

2058798 9/1979 United Kingdom ..... 252/301.24

*Primary Examiner*—Arthur P. Demers

*Attorney, Agent, or Firm*—Joseph G. Kolodny

[57] ABSTRACT

A process is described for the preparation of concentrated liquid formulations, stable on storage, of anionic fluorescent brighteners, which process consists in passing a crude (for example obtained from synthesis) aqueous solution or dispersion of a fluorescent brightener containing sulfo groups, in particular a stilbene fluorescent brightener belonging to the group comprising bis-triazinylaminostilbenedisulfonic acids, bis-styrylbiphenyls, bis-styrylbenzenes and bis-triazolylstilbenedisulfonic acids, is passed through a semipermeable membrane which contains ionic groups and has a pore diameter of 1–500 Å in order to remove salts and by-products from the synthesis having molecular weights below 500 and in order to remove part of the water. The resulting concentrated preparation can, if desired, be concentrated further and/or treated with formulation assistants and, if desired, further additives.

23 Claims, No Drawings

PROCESS FOR THE PREPARATION OF FLUORESCENT BRIGHTENER FORMULATIONS WHICH ARE STABLE ON STORAGE

The present invention relates to a process for the preparation of concentrated liquid formulations, stable on storage, of anionic fluorescent brighteners, to the fluorescent brightener formulations which can be obtained by this process and to the use thereof for the fluorescent brightening of natural and synthetic fibre materials, for example textile materials and paper.

The use of fluorescent brighteners, in particular stilbene fluorescent brighteners containing sulfo groups, in the form of concentrated aqueous or organic-aqueous solutions, often known as "liquid fluorescent brighteners", has achieved an increased industrial importance in recent years. The principal advantages of such formulations compared with powder formulations are avoidance of dust, simpler handling, omission of drying and improved meterability. Liquid formulations of this type should contain high concentrations of fluorescent brighteners, preferably at least 10% by weight of active substance. For example, concentrations between 10 and 40% by weight should be possible. These formulations are stated to be stable for several months without change in a wide temperature range of, for example, −10° C. to +40° C.

In the simplest case, a "liquid fluorescent brightener" consists of an aqueous, electrolyte-containing reaction solution containing 10–40% of active substance, such as is produced in the synthesis of the fluorescent brightener compound. In most cases, however, the solubility of the fluorescent brightener is not sufficient to produce a stable aqueous solution having the desired content of active substance, in the presence of the inorganic salt originating from the reaction. As a rule, it is not possible to improve the stability to the extent desired by adding solubilisers, such as urea, glycols, polyglycols, alkanolamines and the like.

In order to solve the problem which has been mentioned, it is generally customary first to isolate, in a sparingly soluble form, the fluorescent brighteners used in the synthesis and thus to free them from the bulk of the burden of inorganic salts. For example, it is suitable for this purpose to convert the fluorescent brighteners into their "free acid" or into an intermediate stage partially precipitated by acidification. A stable, liquid commercial form having a low content of inorganic salts is obtained by neutralizing, with a base, the compound which can be isolated in this manner, and, if desired, by adding formulating agents. However, the method does not always provide satisfactory results. On the one hand a number of compounds are precipitated on acidification only in forms which are amorphous and in some cases difficult to filter, and, on the other hand, the required sparingly soluble state cannot be achieved in every case. In the case of compounds containing reactive groups, precipitation by acidification is frequently also associated with an impairment in quality.

A process for the preparation of strictly aqueous solutions of anionic dyes and fluorescent brighteners with the aid of ultrafiltration through a membrane is known from German Auslegeschrift No. 2,204,725. However, the formulations of fluorescent brighteners resulting therefrom are insufficiently stable on storage and their preparation is associated with certain difficulties.

German Offenlegungsschrift No. 2,805,891 teaches a process, for the preparation of concentrated aqueous solutions of dyes and fluorescent brighteners, in which inorganic salts are removed by means of a membrane process. However, this process suffers from the disadvantage that, in the case of anionic dyes or fluorescent brighteners, the latter must then be converted into certain ammonium salts or into lithium salts, as a result of which the process becomes complicated and is also likely to be disadvantageous from the point of view of economy.

It was, therefore, the object of the invention to seek a method for the preparation of concentrated liquid formulations of fluorescent brighteners of low electrolyte content and stable on storage, which does not have the disadvantages of the methods or formulations mentioned above.

This object becomes possible in a process which starts direct from synthesis solutions or dispersions of the fluorescent brightener compounds and in which these solutions or dispersions are freed from salts by means of a specific membrane, freed from by-products of the synthesis having a molecular weight less than 500 and, if desired, are concentrated. This method gives concentrated formulations which have a low electrolyte content and which are simpler to prepare compared with the state of the art mentioned above and which also produce good results in cases where isolation in a form of low electrolyte content by precipitation by acidification (see above) is scarcely still possible.

The present invention therefore relates to a process which comprises passing a crude aqueous solution or dispersion of at least one anionic fluorescent brightener, in particular a fluorescent brightener containing sulfo groups, through a semipermeable membrane which contains ionic groups and has a pore diameter of 1 to 500 Å, in order to remove salts and by-products from the synthesis having molecular weights less than 500 and to remove part of the water, if appropriate concentrating the resulting mixture further or diluting it and treating it, if appropriate, with one or more formulation assistants before and/or after it has passed through the semipermeable membrane. This method gives concentrated fluorescent brightener formulations (in the form of solutions or dispersions) which are stable on storage and have an electrolyte content of less than 1% by weight, based on the whole formulation.

Electrolytes are to be understood in this context as meaning salts which originate from the synthesis of the fluorescent brightener active substance or which have been added by neutralising and/or salting out the fluorescent brightener and are carried along in the reaction mass or are added later, such as alkali metal salts, alkaline earth metal salts or ammonium salts, for example ammonium chloride, acetate, sulfate or bisulfate, magnesium chloride, acetate, sulfate or bisulfate, lithium chloride, acetate, sulfate or bisulfate, sodium chloride, acetate, sulfate or bisulfate or potassium chloride, acetate, sulfate or bisulfate, but particularly sodium chloride.

The particularly advantageous properties of the fluorescent brightener formulations which can be prepared by the process according to the invention are caused by the special semipermeable membranes used in this osmosis process.

Semipermeable membranes which can be used in accordance with the invention should retain higher-molecular substances while ensuring a high rate of flow of water and dissolved substances having a low molecular weight, for example salts, such as sodium chloride, sodium sulfate, potassium chloride, ammonium sulfate, sodium phosphate, potassium sulfate or sodium acetate, or low-molecular impurities, for example unreacted or partially decomposed starting materials. They should, however, also be able to separate ions of various charges.

The retention or separation ("cut off level") is determined by the molecular weight and/or the ionic charge. This so-called membrane hyperfiltration is also known as reverse osmosis and is related to ultrafiltration. This term is understood to mean separation processes within the molecular range.

Suitable membranes which can be used in accordance with the invention are advantageously semipermeable, charged, preferably asymmetrical membranes, the pores of which have a diameter of 1 to 500 Å. They advantageously consist of organic material containing ionic groups. These membranes have a "cut off level" of 300 to 500. Membranes having a "cut off level" of 400 to 500 are particularly suitable for the process according to the present invention. They permit water, if appropriate mixed with organic solvents and dissolved substances which, by virtue of their molecular sizes, are below the "cut off level", to pass through at high rates per unit area and under a low to medium pressure. The pressures used in accordance with the invention are, for example, 10 to 100 bar, preferably 10 to 30 bar and particularly 20 to 30 bar. The pressure can be exerted, for example, by means of a pump.

The desalting effect in a filtration process can be up to 70% or more without loss of fluorescent brightener. In the course of the filtration the volume of the solution of the retained substances (the concentrate side) decreases correspondingly and the concentration of the fraction retained increases correspondingly. If a further reduction in the low-molecular component is desired, this can be achieved without difficulties by diluting the retained solution or suspension with water, advantageously to the initial volume, by repeating the process once or several times. The separation can also be carried out continuously by adjusting the feed rate of the water to suit that of the decrease in the permeate. Desalting and purifying effects of up to 95% or, if desired, even up to 99% or more, i.e. until the permeate is free from undesirable substances, can be achieved discontinuously and continuously in this simple manner at room temperature.

The preferred membranes which can be used in accordance with the invention consist essentially of a polymeric substance which, at least on the surface, is modified by radicals having ionisable groups. Modified natural, semi-synthetic or synthetic materials can be processed to give membranes in this manner. The polymeric substance to be modified in this manner contains, as examples of reactive groups, hydroxyl and/or amino groups. It can then be reacted with suitable reagents which, on the one hand, contain ionisable groups and, on the other hand, contain at least one grouping capable of reacting with the formation of a covalent bond. The following polymeric compounds, for example, can be modified in the manner indicated: polymeric electrolytes, polyvinyl alcohols, cellulose ethers or esters, such as cellulose nitrate or propionate, preferably cellulose acetates, for example those having a low content of acetyl groups, but also more highly acylated cellulose, for example so-called two and a half acetate, or polyacrylonitrile and copolymers formed from acrylonitrile and other ethylenically unsaturated monomers. Membranes which have proved technically suitable are, in particular, those made of cellulose acetate, polyacrylonitrile or copolymers formed from acrylonitrile and, for example, vinyl alcohol or vinyl acetate.

Suitable reactive reagents containing an ionisable group are colourless and coloured compounds, for example ionic reactive dyes which can belong to various categories, such as anthraquinone, azo or formazan dyes. Suitable colourless compounds of this type are, for example, derivatives of 4,4'-diaminostilbene-2,2'-disulfonic acid, for example 4,4'-bis-(4'',6''-dichlorotriazin-2''-yl)-aminostilbene-2,2'-disulfonic acid and similar compounds. The following may be mentioned as reactive groups which make it possible to attach these reagents to the starting polymers: carboxylic acid halide groups, sulfonic acid halide groups, radicals of $\alpha,\beta$-unsaturated carboxylic acids or amides, for example radicals of acrylic, methacrylic, $\alpha$-chloroacrylic or $\alpha$-bromoacrylic acid, acrylamide radicals, radicals of, preferably lower, halogenoalkylcarboxylic acids, for example radicals of chloroacetic acid, $\alpha,\beta$-dichloropropionic acid or $\alpha,\beta$-dibromopropionic acid; radicals of fluorocyclobutanecarboxylic acids, for example radicals of trifluorocyclobutanecarboxylic or tetrafluorocyclobutanecarboxylic acid; radicals containing vinylacyl groups, for example vinylsulfonyl groups or carboxyvinyl groups; radicals containing ethylsulfonyl groups ($-SO_2CH_2CH_2OSO_2OH$ or $-SO_2CH_2CH_2Cl$) or ethylaminosulfonyl groups ($-SO_2NHCH_2CH_2OSO_2OH$) and halogenated heterocyclic radicals, for examples radicals of dihalogenoquinoxalines, dihalogenopyridazones, dihalogenophthalazines, halogenobenzothiazoles or, preferably, halogenated pyrimidines or 1,3,5-triazines, for example radicals of monohalogenotriazines, dihalogenotriazines, 2,4-dihalogenopyrimidines or 2,5,6-trihalogenopyrimidines. Suitable halogen atoms in the radicals mentioned above are fluorine, bromine and, in particular, chlorine atoms.

Examples of suitable ionisable groups are sulfato groups, sulfonic acid groups, sulfonic acid amide groups, carboxylic acid groups, carboxylic acid amide groups, hydroxyl groups, thiol groups, isocyanate and/or thioisocyanate groups, ammonium groups formed from primary, secondary or tertiary amino groups and also phosphonium or sulfonium groups. Reactive compounds (reactive dyes) containing sulfonic acid, carboxylic acid or ammonium groups are preferred.

Particularly advantageous results are achieved in some cases using compounds containing sulfonic acid groups. Polymer membranes modified by an azo dye containing sulfonic acid groups are particularly valuable and applicable in many ways. The azo dye can also contain a metal attached in the form of a complex, for example copper.

Membranes composed of (partially acetylated) cellulose acetate can be modified, for example, by reaction with the reactive ionic compounds mentioned previously, in particular anionic reactive dyes (c.f., for example, U.S. Pat. No. 4,247,401).

A further modification of cellulose acetate can be effected, for example by means of the following chemical reactions (in the sequence indicated): a polyfunctional monomeric compound containing at least two functional groups (for example cyanuric chloride), a polyfunctional oligomer or polymer (for example polyethyleneimine), and an ionic compound (for example ionic reactive dyes, reactive groupings and ionic groups as indicated) (c.f. for example, European Laid-Open Specification No. 26,399 [U.S. patent application Ser. No. 190,524 now abandoned]).

Membranes containing polyvinyl alcohol can also be modified in an analogous manner.

The polyfunctional monomeric compound preferably has at least 2 functional groups. Suitable compounds are cyclic carbonic acid imide-halides, isocyanates, isothiocyanates or N-methylol compounds, halogenodiazines or halogenotriazines, for example cyanuric halides (cyanuric chloride) or trihalogenpyrimidines or tetrahalogenopyrimidines (tetrachloropyrimidine) being particularly suitable.

The polyfunctional oligomers or polymers contain, in particular, aliphatic or aromatic amino, hydroxyl, thiol and also isocyanate and/or thioisocyanate groups. Suitable polyfunctional polymers are polyethyleneimine, polyvinyl alcohol, cellulose derivatives, polyvinylamine or polyvinylaniline; polyethyleneimine is preferred.

As the ionic group, the membrane preferably contains sulfonic acid groups, carboxylic acid groups or ammonium groups. Membranes containing radicals of an anionic reactive dye are particularly advantageous.

However, it is also possible to use membranes consisting of a basic structure containing polyacrylonitrile or a polymer formed from acrylonitrile and other ethylenically unsaturated monomers (c.f., for example, Published U.K. Patent Application No. 2,058,798 A).

By reaction with hydroxylamine, amidoxine groups are introduced into the membrane, which is then modified as indicated for the cellulose acetate membranes (in accordance with European Laid-Open Specification No. 26,399).

The proportion of acrylonitrile units in the basic structure of the membrane is advantageously at least 5, and preferably at least 20, percent by weight. Copolymers of acrylonitrile and vinyl acetate, vinyl ethers, vinylpyridine, vinyl chloride, styrene, butadiene, (meth-)acrylic acid, maleic anhydride, 2-aminomethyl methacrylate or allyl compounds or terpolymers or tetrapolymers based on acrylonitrile are preferred.

The membranes modified in this way can, if desired, also be subjected to a heat treatment. The pore size of the membrane skin is largely determined by the heat treatment. The membrane is treated, for example, for 1 to 30 minutes at a temperature of 60° to 90° C., advantageously by immersing it in warm water. If desired, the heat treatment can also be carried out before the reaction with the reactive compound containing ionisable groups. Furthermore, the reaction can also be carried out before the polymeric material is processed to give the asymmetrical membrane.

The membranes can have various forms and can, for example, be in the form of plates, sheets, tubes, a pocket, a cone or hollow fibres. In order to be able to employ them effectively for the separation of substances, they must be integrated into appropriate systems (modules) and incorporated in equipment (for pressure permeation).

Within the range indicated earlier in the text, the pore size can be varied by graduated heat treatment and can also be adjusted to suit the particular end use. It is advantageous for the average charge density (equivalent to the content of ionisable groups) of the membrane to be 1 to 100 milliequivalents per kg of dry membrane.

The membranes described, which, in accordance with the invention, are employed in accordance with the principle of reverse osmosis, are advantageously membranes which have separation limits within the molecular weight range from 300 to 500, preferably 400 to 500, and which are symmetrical or, in particular, asymmetrical. They permit water and dissolved substances which, by virtue of their molecular weight, are below the separation limit to pass through at high rates per unit of surface and under low to medium pressure. Pressures of 10 to 100 bar, preferably 10 to 30 bar, are used in accordance with the invention. The pressure can be exerted, for example, by means of a pump. pH values and temperatures can vary within wide limits when carrying out the process. They are, as a rule, not critical for the membranes employed.

In the process according to the invention it is preferable to employ membranes such as are described in U.S. Pat. No. 4,247,401, in U.K. Published Patent Application No. 2,058,798 A (=U.S. patent application Ser. No. 189,978 now abandoned) and in European Laid-Open Specification No. 26,399 (=U.S. patent application Ser. No. 190,524 now abandoned). Specific instructions for preparation can be found in the example section.

Anionic fluorescent brighteners can be formulated in the manner indicated above by means of the process according to the invention. These anionic fluorescent brighteners can belong to various categories of products. In practice, they are, in particular, paper, textile and detergent fluorescent brighteners having a solubility in water or in organic-aqueous systems which depends considerably on the content of inorganic salts.

Primarily, fluorescent brighteners containing sulfo groups, in particular stilbene fluorescent brighteners, especially those of the type of the bis-triazinylaminostilbenedisulfonic acids, the bis-styrylbiphenyls, bis-styrylbenzenes and the bis-triazolylstilbenedisulfonic acids, are formulated in accordance with the process according to the invention. The fluorescent brighteners can be used on their own or as mixtures of several fluorescent brighteners.

The fluorescent brighteners containing sulfonic acid groups are preferably used in the present process in the form of their metal salts, such as are produced in the synthesis, for example lithium, potassium, magnesium or, in particular, sodium salts, and also ammonium, amine or alkanolamine salts. It is also possible to use mixtures of salts or a fluorescent brightener compound which has been partially acidified or fluorescent brighteners in the form of the "free acid".

It is preferable to formulate, by means of the process according to the invention, stilbene fluorescent brighteners containing sulfo groups and having the formula

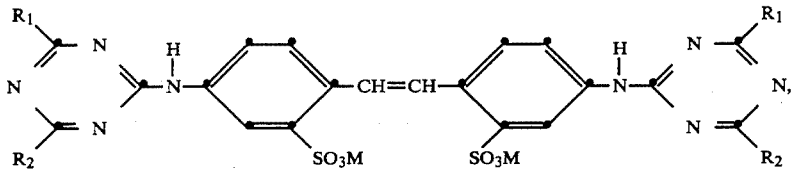

in which M is hydrogen or an alkali metal ion, an alkaline earth metal ion, an ammonium ion or an amine salt ion, and $R_1$ and $R_2$ independently of one another are $NH_2$, $NH—CH_3NH—C_2H_5$, $N(CH_3)_2$, $N(C_2H_5)_2$, $NH—CH_2—CH_2—OH$, $NH—CH_2—CH_2—CH_2—OH$, $N(CH_2—CH_2—OH)_2$, $N(CH_2—CH_2—CH_2OH)_2$, $N(CH_3)(CH_2—CH_2—OH)$, $NH—CH_2—CH_2—O—CH_2—CH_2OH$, $NH—CH_2—CH_2—SO_3M$, OH, $OCH_3$, $OCH(CH_3)_2$, $O—CH_2—CH_2—O—CH_3$,

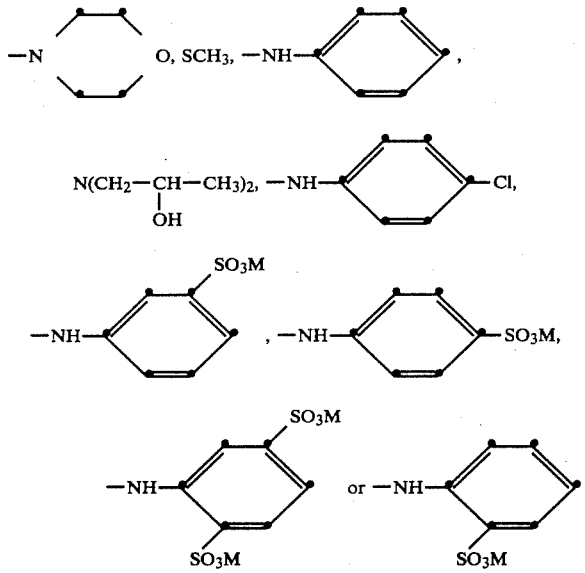

in which M is hydrogen or an alkali metal ion, an alkaline earth metal ion, an ammonium ion or an amine salt ion, of the formula

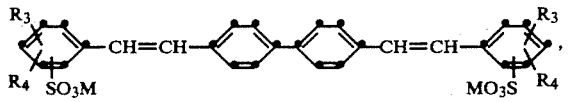

in which $R_3$ is hydrogen, alkyl having 1 to 4 carbon atoms, alkoxy having 1 to 4 carbon atoms, halogen or $SO_3M$, $R_4$ is hydrogen or alkyl having 1 to 4 carbon atoms and M is hydrogen or an alkali metal ion, an alkaline earth metal ion, an ammonium ion or an amine salt ion, or of the formula

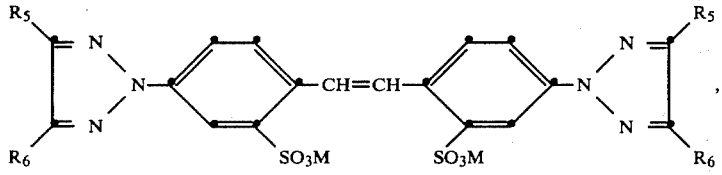

in which M is hydrogen or an alkali metal ion, an alkaline earth metal ion, an ammonium ion or an amine salt ion and $R_5$ and $R_6$ independently of one another are hydrogen, $CH_3$,

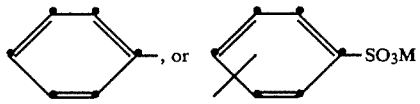

or $R_5$ and $R_6$ together complete a benzene ring.

The sulfo group $—SO_3M$ in the compounds of the above formulae can be in the free form (M=H) or in the salt form; in the latter case M is then preferably an alkali metal ion, in particular a sodium, lithium or potassium ion, an ammonium ion or an amine salt ion, for example an ion of a primary or secondary alkylamine, it being possible for the alkyl group(s) to be substituted by halogen, hydroxyl (for example ethanolamine, diethanolamine or triethanolamine) or alkoxy, or of a cyclic amine, for example a piperidine, pyrrolidine, piperazine or morpholine. M' can also be an alkaline earth metal ion, for example a magnesium or calcium ion.

The content of active substance in the fluorescent brightener formulations obtainable in accordance with the invention is, for example, 10–60% by weight, and is preferably between 10 and 40% by weight. The formulations have an electrolyte content of not more than 1% by weight, preferably not more than 0.5% by weight and, in particular, not more than 0.1% by weight, based on the total formulation.

The process according to the invention is carried out, for example, as follows:

An aqueous solution or suspension of the fluorescent brightener is first passed through a semipermeable membrane in which the pores have a diameter of 1–500 Å.

The reaction mixture obtained direct from the synthesis or an aqueous dispersion of the moist filter cake or of dried products can be used as the starting solution or dispersion. As a rule, the fluorescent brighteners which are employed as the starting material contain undesirable dissolved substances having a low molecular weight, particularly the by-products formed in the synthesis and also inorganic and/or organic salts. If desired, the synthesis mixture can be diluted with water before it is passed under pressure through the membrane used, in order to remove products having molecular weights below the "cut off level" of this membrane.

At the same time the mixture is concentrated to an active compound content of about 15–50%.

In a "filtration process" the degree of desalting can be up to 70% or more without loss of fluorescent brightener. In the course of this process, the volume of the solution or suspension of the retained substances decreases correspondingly, and the concentration of the latter increases correspondingly.

If a further reduction in the low-molecular components is desired, this can be achieved by diluting the retained solution or dispersion with water once or several times, and repeating the process. The separation can also be carried out continuously by making the feed rate of the water correspond to that of the decrease in the permeate. Desalting and purifying effects of 99% or more are possible, operating either discontinuously or continuously.

The process according to the invention not only makes it possible to prepare aqueous or organic-aqueous fluorescent brightener formulations having improved properties, but it also offers technical advantages compared with the conventional processes, for example by enabling protracted filtration stages to be eliminated and time and energy to be saved thereby.

It also permits, without loss of quality, the preparation in a form of low salt content of fluorescent brighteners containing reactive groups and also of fluorescent brightener precursors and of incompletely substituted compounds.

In one embodiment of the process according to the invention, the concentrated solution obtained on the membrane can be used without further treatment as a formulation. If desired, it can also be diluted with water (if the concentration of fluorescent brightener is too high or if the whole quantity of fluorescent brightener is not dissolved) or, in order to achieve further concentration (if the content of fluorescent brightener is too low), it can, for example, be concentrated, for example by removing water by vaporisation. Strictly aqueous fluorescent brightener formulations are produced in this manner.

Sometimes, however, it is advantageous to add one or more formulation assistants either to the crude solution before it passes through the semipermeable membrane or, preferably, to the desalted and/or concentrated solution after osmosis has been carried out, if appropriate after further concentration. This is particularly suitable if either the stability of the formulation can thereby be further increased or an even higher concentration of fluorescent brightener in the formulation can be achieved thereby, or if the quality of the formulation in any other respect can be favourably effected thereby (for example also insensitivity towards cold). Aqueous-/organic fluorescent brightener formulations are produced from this embodiment of the process according to the invention.

Furthermore it is also possible to incorporate into the otherwise finished formulations further customary additives which are not directly concerned with stability or concentration of active substance. Additives of this type (for example dyeing assistants) are intended to provide advantages, for example in the use of the fluorescent brightener formulations (application in the textile, detergent or paper fields). It is also possible to add anti-foaming agents, bases, water softening compounds and also substances which prevent the formulations being attacked by fungi and bacteria (germicidal substances).

Examples of suitable formulation assistants mentioned above in the process according to the invention are solvents (solubilisers) and polar organic substances, for example the polyhydric alcohols which are liquid at room temperature or ethers and/or esters thereof, such as ethylene glycol, propylene glycol, diethylene glycol, triethylene glycol, tetraethylene glycol, glycerol, 2-methylpentane-2,4-diol, ethylene glycol monomethyl, monoethyl or monobutyl ether, propylene glycol monomethyl, monoethyl or monobutyl ether, diethylene glycol monomethyl, monoethyl or monobutyl ether, triethylene glycol monobutyl ether, dipropylene glycol, glycerol 1,3-diethyl ether, diethylene glycol monoethyl ether-acetate, diethylene glycol monoacetate, thiodiglycol, polyethylene glycols and water-soluble polyethers; monohydric alcohols, such as propanol or isopropanol; and also ketones and hydroxyketones, such as methyl ethyl ketone, acetonylacetone and especially diacetone-alcohol, if appropriate monoalcohols containing ether groups, such as isopropyl alcohol, glycerol formal (5-hydroxy-1,3-dioxane or 5-hydroxymethyl-1,3-dioxolane), 2-hydroxymethyltetrahydropyran and especially tetrahydrofurfuryl alcohol and also cyclic ethers and esters, such as tetrahydrofuran, dioxane, glycol formal (1,3-dioxolane) and ethylene carbonate (1,3-dioxol-2-one).

The following can also be used as solvents or polar organic compounds: lactams and lactones, such as N-methylpyrrolidone, cyclohexylpyrrolidone, 1,5-dimethylpyrrolidone and especially $\gamma$-butyrolactone, esters of aliphatic hydroxycarboxylic acids, such as ethyl lactate and ethyl hydroxybutyrate, nitriles which may contain hydroxyl groups, such as acetonitrile or $\beta$-hydroxypropionitrile, and also sulfur-containing compounds, such as derivatives of 2,5-dihydrothiophene 1,1-dioxide (sulfolene) or of tetrahydrothiophene 1,1-dioxide (sulfolane) which are unsubstituted or substituted in the $\alpha$-position and/or $\beta$-position by alkyl or hydroxyalkyl groups, or, in particular, dimethyl sulfoxide. Further suitable compounds are also amides of low-molecular aliphatic carboxylic acids, such as formamide or N,N-dimethylformamide, but preferably amides of carboxylic acids having at least two C atoms, such as N,N-dimethylacetamide or N,N-dimethylmethoxyacetamide, methylated amides of carbonic acid or phosphoric acid, for example N,N,N',N'-tetramethylurea or methylphosphonic acid bis-N,N-dimethylamide, and especially hexamethylphosphoric acid triamides and other phosphorus compounds, such as phosphoric or phosphonic acid esters such as, in particular, methylphosphonic acid dimethyl ester, and also alkanolamines, for example ethanolamine; urea, ethylene carbonate, propylene carbonate, caprolactam, trimethylolethane, lactic acid amide or tetrahydroxymethylmethane (pentaerythritol).

The following are preferred solvents (solubilisers) and/or polar organic compounds of this type: lower monohydric aliphatic and cycloaliphatic alcohols, polyhydric alcohols, ether-alcohols, glycols, polyglycols, glycol ethers, polyglycol ethers, cyclic ethers and esters, nitriles, lactams, lactones, esters of aliphatic hydroxycarboxylic acids, derivatives of 2,5-dihydrothiophene 1,1-dioxide or of tetrahydrothiophene 1,1-dioxide which are unsubstituted or substituted in the $\alpha$-position and/or $\beta$-position by alkyl or hydroxyalkyl, low-molecular aliphatic carboxylic acid amides, methylated amides of carbonic acid or phosphoric acid, phosphoric and phosphonic acid esters or amines, in particular alkanolamines, or mixtures of such solvents, dimethyl sulfoxide, dimethyl methylphosphonate, dimethyl sulfone, sulfolane, ethylene carbonate, propylene carbonate, urea or substituted ureas or mixtures of such compounds.

The formulation assistants of this type which are most important in practice are urea, glycols, polyglycols and alkanolamines.

Furthermore, it is also possible to employ nonionic or anionic surfactants as formulation assistants. The following, inter alia, are examples of nonionic surfactants: adducts of alkylene oxides, in particular ethylene oxide, onto higher fatty acids, fatty acid amides, aliphatic alcohols, mercaptans or amines, alkylphenols or alkylthiophenols in which the alkyl radicals have at least 7 carbon atoms, or phenylphenols, for example polyglycol monoalkylphenyl ethers in which the alkyl group has 8 to 12 carbon atoms, having at least 8 substituted or unsubstituted glycol units, such as decaethylene glycol monooctylphenyl ether or the reaction product of mononononylphenol with 5 to 35 mols of ethylene oxide; block polymers formed from ethylene oxide and higher alkylene oxides, for example propylene oxide or butylene oxide, nonionic esters of the adducts of alkylene oxides, for example the tertiary phosphoric acid ester of the adduct of 40 mols of ethylene oxide onto mononononylphenol; esters of polyalcohols, in particular monoglycerides of fatty acids having 12 to 18 carbon atoms, for example the monoglycerides of lauric, stearic or oleic acid; N-acylated alkanolamines of the same type as those mentioned in the case of the sulfates of these compounds (see below), for example the N,N-bis-($\omega$-hydroxalkyl)-amides of the mixtures of acids embraced under the collective term "coconut oil fatty acids", in particular N,N-bis-($\beta$-hydroxyethyl)- or N,N-bis-($\gamma$-hydroxypropyl)-amides, and also the adducts of ethylene oxide onto these N-acylated alkanolamines; and reaction products of higher fatty acids with an alkanolamine in which the molar ratio of alkanolamine to fatty acid is greater than 1, for example 2. Suitable fatty acids are, in particular, those having 8 to 18 carbon atoms and also the mixtures known as coconut oil fatty acids, while suitable alkanolamines are, in particular, diethanolamine.

The following are examples of anionic surfactants which can be used: sulfated alkylene oxide adducts, in particular sulfated ethylene oxide adducts, such as sulfated adducts of 1 to 40 mols of ethylene oxide onto fatty acid amides, mercaptans or amines, but especially onto fatty acids, aliphatic alcohols or alkylphenols having 8 to 20 carbon atoms in the alkyl chain, for example stearic acid, oleic acid, lauryl alcohol, myristyl alcohol, stearyl alcohol, oleyl alcohol, octylphenol or nonylphenol. Instead of the sulfates, it is also possible to use the esters of other polybasic acids. These include, for example, the primary and secondary esters of phosphoric acid and also the half-esters of sulfosuccinic acid; sulfates of N-acylated alkanolamines, for example the sulfated amides of caprylic, pelargonic, capric, lauric, myristic or stearic acid or of lower fatty acids which are substituted by alkylphenoxy groups, such as octylphenoxyacetic or nonylphenoxyacetic acid, with monohydroxyalkylamines or bis-hydroxyalkylamines, such as $\beta$-hydroxyethylamine, $\gamma$-hydroxyethylamine, $\gamma$-hydroxypropylamine, $\beta,\gamma$-dihydroxypropylamine or bis-($\beta$-hydroxyethyl)-amine, or with N-alkyl-N-hydroxyalkylamines, such as N-methyl-N-($\beta$-hydroxyethyl)-amine or N-ethyl-N-($\beta$-hydroxyethyl)-amine; and sulfated esterified polyhydroxy compounds, for example sulfated, partially esterified, polyhydric alcohols, such as the sodium salt of the sulfated monoglyceride of palmitic acid.

It is preferable to incorporate the following surfactants in the fluorescent brightener formulations which can be obtained in accordance with the invention: nonionic surfactants, such as adducts of alkylene oxides onto higher fatty acids, fatty acid amides, aliphatic alcohols, mercaptans, amines, alkylphenols, alkylthiophenols or phenylphenols, block polymers formed from ethylene oxides and higher alkylene oxides, nonionic esters of the adducts of alkylene oxides, esters of polyalcohols, N-acylated alkanolamines and adducts thereof with ethylene oxide and reaction products formed from higher fatty acids with an alkanolamine; or anionic surfactants, such as alkylene oxide adducts onto sulfate radicals or other acid radicals, sulfates of N-acylated alkanolamines and sulfated esterified polyhydroxy compounds.

The following, in particular, are suitable as further additives: water softening compounds, dyeing assistants, anti-foaming assistants, for example silicone oils, and substances which inhibit the growth of fungi and/or bacteria (germicidal substances) and also bases, such as KOH, NaOH, LiOH, ammonium hydroxide and alkylamines, for example alkylamines having 1 to 6 carbon atoms, such as ethylamine or methylamine.

The present invention also relates to the fluorescent brightener formulations obtained by the process according to the invention themselves. For example, formulations, according to the invention, of this type contain 10–60, preferably 10–40, % by weight of at least one anionic fluorescent brightener, 15–90% by weight of water, 0–50% by weight of formulation assistants and 0–35% by weight of further additives.

The content of inorganic inert salts (electrolytes, for definition see above) is in practice not more than 1% by weight, preferably not more than 0.5% by weight and, in particular, not more than 0.1% by weight, in each case based on the total formulation.

Depending on the type of the dissolved fluorescent brightener, the formulations according to the invention can be used for fluorescent brightening of a very wide variety of high-molecular organic materials. This use, and the process for optically brightening these materials with the aid of the formulations according to the invention also form part of the subject of the invention. Examples of suitable substrates to be optically brightened are synthetic, semi-synthetic or natural textile fibres, paper or detergents.

Paper can either be brightened directly by adding the formulations according to the invention to the paper pulp, if appropriate after adding assistants which are customary in the manufacture of paper, or a formulation according to the invention can be incorporated into conventional paper coating compositions (for example those based on a synthetic resin or starch) and the latter can then be used in a conventional manner for coating paper.

Since the formulations according to the invention can be diluted with water very readily and rapidly, they are also excellently suitable for fluorescent brightening of textile substrates by the customary fluorescent brightener application processes (for example the exhaust method or the pad process).

For this purpose the concentrated formulations are diluted with water to such an extent that the application liquors formed therefrom, to which customary assistants can also be added, contain the desired concentrations of fluorescent brightener.

Textile fibres which are suitable for fluorescent brightening are those made of synthetic materials, for example polyamide, of semi-synthetic materials, for example regenerated cellulose, and of natural materials, for example wool or cotton, and of mixed fibres, for example polyester/cotton, it being also possible for the natural fibres to be finished in the manner customary in the textile industry.

The textile materials to be subjected to fluorescent brightening can be in various states of processing (raw materials, semi-finished goods or finished goods). Fibre materials can, for example, be in the form of staple fibres, flocks, hanks, textile filaments, yarns, threads, fibre fleeces, felts, waddings, flocked structures, textile laminates or knitted fabrics, but preferably in the form of woven textile fabrics.

The treatment of the latter is effected using the dilute solutions according to the invention, if desired after added dispersing, stabilising, wetting and/or further assistants.

Depending on the dissolved fluorescent brightener, it can prove advantageous to carry out the treatment preferably in a neutral, alkaline or acid bath. The treatment is usually carried out at temperatures of about 20° to 140° C., for example at the boiling point of the bath or near it (about 90° C.).

It is also possible, in addition, to add the following assistants to the bath: dyes (shading), pigments (coloured pigments or, in particular, for example, white pigments), so-called "carriers", wetting agents, softeners, swelling agents, antioxidants, light stabilisers, heat stabilisers, chemical bleaching agents (chlorite bleaches or additives for bleaching baths), crosslinking agents, finishing agents (for example starch or synthetic finishes) and agents which can be used in a very wide variety of textile finishing processes, in particular agents for synthetic resin finishes (for example crease-resistant finishes, such as "wash-and-wear", "permanent-press" or "no-iron"), and also flame-resistant, soft handle, anti-soiling or antistatic finishes or anti-microbial finishes.

In certain cases an after-treatment is carried out after the treatment with the fluorescent brightener solution. This can, for example, represent a chemical treatment (for example acid treatment), a heat treatment or a combined chemical-technical treatment. Thus, for example, the advantageous procedure to follow in subjecting a number of fibre substrates to fluorescent brightening is to impregnate these fibres with the aqueous solutions described at temperatures below 75° C., for example at room temperature, and to subject them to a dry heat treatment at temperatures above 100° C., it being generally advisable additionally to dry the fibre material beforehand at a moderately elevated temperature, for example at not less than 60° C. and up to about 130° C. The heat treatment in the dry state is then advantageously carried out at temperatures between 120° and 225° C., for example by heating in a drying chamber, by ironing within the temperature range indicated or by treatment with dry, superheated steam. The drying and the dry heat treatment can also be carried out in immediate succession or can be combined in a single process stage.

The dilution of the concentrated fluorescent brightener formulations according to the invention to give the corresponding application liquors is carried out in such a way that, when the appropriate substrate is impregnated, the fluorescent brightener is absorbed onto the latter in an amount of not less than 0.0001% by weight, but not more than 2% by weight, preferably an amount between 0.0005 and 0.5% by weight. Depending on the liquor ratio to be used, the nature of the substrate and the dissolved fluorescent brightener, the concentration required can be calculated in a simple manner from these values.

The aqueous application liquors which are used for the treatment of textile fibres and represent, as described above, a dilution of the formulations according to the invention and which can, if desired, also contain assistants customary in dyeing practice, such as are listed as examples above, also form part of the subject of the present invention.

The formulations according to the invention can also be added to wash liquors or detergents. A quantity of the formulation sufficient to contain the desired quantity of fluorescent brightener is simply metered into wash liquors. The formulations according to the invention can be added to detergents at any stage of the manufacturing process, for example to the so-called "slurry" before the washing powder is spray-dried, or during the preparation of liquid detergent combinations.

Possible washing agents are the known mixtures of detergent substances, for example soap in the form of chips and powder, synthetics, soluble salts of sulfuric acid half-esters of higher fatty alcohols, arylsulfonic acids containing higher and/or multiple alkyl substituents, sulfocarboxylic acid esters of medium to higher alcohols, fatty acid acylaminoalkylglycerolsulfonates, or acylaminoarylglycerolsulfonates, phosphoric acid esters of fatty alcohols and the like. Examples of suitable so-called "builders" are alkali metal polyphosphates and polymetaphosphates, alkali metal pyrophosphates, alkali metal salts of carboxymethylcellulose and other "soil-redeposition inhibitors", and also alkali metal silicates, alkali metal carbonates, alkali metal borates, alkali metal perborates, nitrilotriacetic acid, ethylenediaminetetraacetic acid, and foam stabilisers, such as alkanolamides of higher fatty acids. The detergents can also contain for example: antistatic agents, superfatting agents, such as lanolin, enzymes, antimicrobial agents, perfumes and dyes.

The quantity of formulation according to the invention which is added to the detergent is so adjusted that the latter then contains about 0.001 to 0.5 percent by weight of fluorescent brightener, based on the solids content of the detergent.

A few advantages which the process according to the invention offers for the preparation of liquid formulations of fluorescent brighteners, in comparison with the processes hitherto customary, will be listed again in order to summarise:

- a higher concentration of fluorescent brightener in the resulting formulations
- improved stability of storage
- technically simpler processing to give the liquid commercial form
- production at lower cost
- higher purity of the fluorescent brighteners owing to lower contamination with salts and by-products.

In the following examples, which illustrate the invention in greater detail, but without limiting it thereto, percentages are percentages by weight, unless stated otherwise.

EXAMPLE 1

30 kg of a mixture obtained by synthesis of the fluorescent brightener of the formula (101)

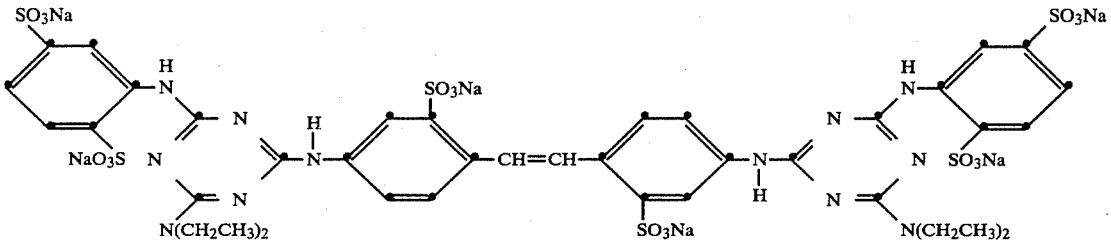

having a solids content of 18.5% (14.5% of active substance and 4% of sodium chloride) are desalted on an apparatus for reverse osmosis having an area of 0.84 $m^2$ of membrane which as a "cut off level" of 500, and are concentrated. The reverse osmosis is carried out in two stages at pH 6.5–7.5, a temperature of 20°–25° C. and a pressure of approximately 25 bar:

(a) Desalting:

The mixture obtained by synthesis, which is in the form of a dispersion, is adjusted to a solids content of approximately 12.3% by adding 15 liters of water. At this dilution the fluorescent brightener dissolves. A total of 30 liters of permeate is now removed at an average flow rate of 25 liters/hour, the volume of the reaction solution being kept constant by continuously adding a further 30 liters of water. A solution of fluorescent brightener which contains approximately 10% of active substance and ≦0.5% of salt is obtained.

(b) Concentration:

After desalting, a further 25 liters of permeate are removed at an average flow rate of 15 liters/hour without adding water. This reduces the salt content even further. Approximately 19.5 kg of fluorescent brightener solution containing 22% of active substance and ≦0.2% of salt are obtained.

After adjusting the fluorescent brightener solution thus obtained to an active substance content of 17% (by adding water), a liquid commercial form which is stable between −2° C. and +100° C. and has the following composition is obtained:

17% by weight of fluorescent brightener of the formula (101), approximately 83% by weight of water, <0.2% by weight of NaCl.

Part of the water can be replaced by 10–20% of urea or other anti-freezing agents in order to improve the stability under cold conditions.

EXAMPLE 2

35 kg of a mixture obtained by synthesis of the fluorescent brightener of the formula (201)

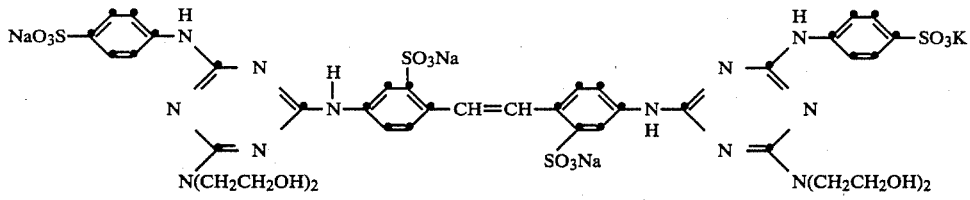

having a solids content of 16% (12% of active substance, 2.8% of sodium chloride and 1.2% of potassium chloride) are desalted and concentrated on the apparatus described in Example 1.

(a) Desalting:

The mixture of sodium and potassium salts obtained by synthesis, in the form of a solution, is adjusted to a solids content of 12% by adding water. Approximately 17 liters of permeate are removed at an average flow rate of 15 liters/hour. In the course thereof, the solids content increases again to approximately 16% and the electrolyte content is reduced from an original value of approximately 4% to 1.5%. The desalting operation is repeated after adding 17 liters of water and an electrolyte content of approximately 0.5% results.

(b) Concentration:

The solution is concentrated to a solids content of 25% at an average flow rate of 10 liters/hour. After adding 2 kg of urea and 2 kg of triethanolamine, 21 kg of a stable organic-aqueous fluorescent brightener formulation having an active substance content of 20% (fluorescent brightener of the formula 201) and an electrolyte content of ≦0.5% are obtained.

EXAMPLE 3

12 kg of moist filter cake of the fluorescent brightener of the formula

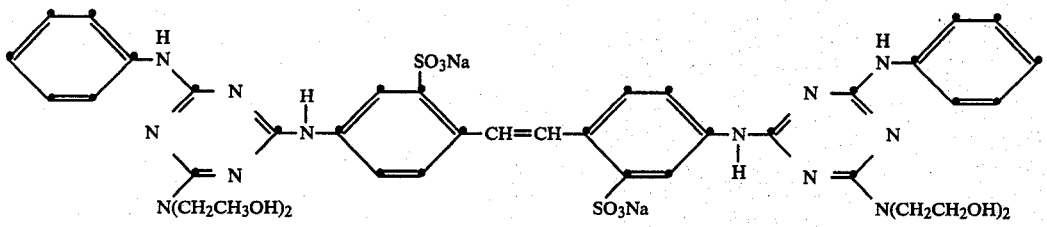

(301)

having a solids content of 36% (30% of active substance and 6% of sodium chloride) are desalted on the apparatus described in Example 1 and are converted into a stable liquid commercial form by adding a formulation auxiliary.

(a) Desalting:

The filter cake is stirred with 28 liters of water to give a homogeneous suspension. A total of 40 liters of permeate is removed at an average flow rate of 10 liters/-hour, the volume of the suspension being kept constant by adding water continuously. This gives an electrolyte content of approximately 0.2%.

(b) Concentration:

After desalting, a further approximate 22 liters of permeate are removed, in the course of which the flow rate decreases to approximately 5 liters/hour. This gives a viscous dispersion containing 22% of active substance. At pH 7.0 the product is partly in the form of the free acid, and the pH is adjusted to 8.5 by adding sodium hydroxide solution, and the product is thus reconverted completely into the disodium salt. Adding 5 kg of urea gives a fluid solution which, in particular, is used as a fluorescent brightener for paper.

Composition of the formulation: 17.2% of fluorescent brightener active substance of the formula (301), 21.6% of urea, 0.2% of sodium chloride and approximately 60.8% of water.

In the reverse osmosis apparatus which is used in Examples 1–3 any of the membranes described above can be used, for example membranes which can be obtained in accordance with the following preparation instructions:

Preparation of membranes:

In accordance with Example 1 of U.S. Pat. No. 4,247,401:

A solution of 25 g of cellulose acetate (degree of acetylation=39.8%), 45 g of acetone and 30 g of formamide is prepared. It is allowed to stand for three days, poured onto a sheet of glass and spread with a spatula to form a layer 0.6 mm thick, the solvent is allowed to evaporate for 5 seconds at 25° C., the sheet of glass is placed in ice-water for 2 hours and the resulting membrane is stripped off the sheet of glass.

The membrane is then immersed in a 5% aqueous solution of the 1:2-chromium complex compound of the dye of the formula

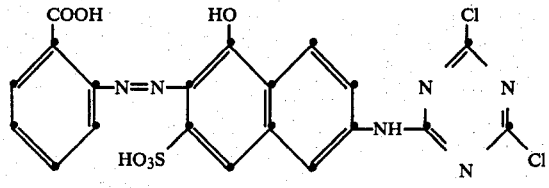

and remains there for 48 hours at a pH value of 6 and a temperature of 25° C. The pH value of the dye solution is then adjusted to 10.4 by adding sodium hydroxide and the solution is agitated continuously for 40 minutes at 25° C.

Instead of treating the membrane with the dye solution in two stages in this way, it can also be treated in a single stage with a 10% solution of the chromium complex dye for 2½ hours at a pH value of 10.5 and at 25° C. For the heat treatment which follows, the membrane is placed in water at 60° C. for 10 minutes.

B. In accordance with Example 1 of U.K. Published Patent Application No. 2,058,798:

A membrane suitable for ultrafiltration, having a maximum pore diameter of 118 Å and composed of an 85:15 acrylonitrile/vinyl acetate copolymer which has the following retention capacity:

2% sodium chloride solution: 6%

1% sodium sulfate solution: 10% dextrin (molecular weight 70,000): 60% is treated for 5 minutes at 65° C. with an aqueous solution which contains 10% of hydroxylamine and 7.5% of sodium carbonate and has a pH value of 6.5. The membrane is then removed from the solution and placed in a stirred solution containing 370 mg of cyanuric chloride per 100 mg of membrane. This solution is kept at a pH value of 10 by adding 1N sodium hydroxide solution for 30 minutes and at 0° C. The membrane is removed from this solution, washed with ice-water and put into a stirred 10% solution of polyethyleneimine (molecular weight 40,000) and is kept there for 5 minutes at room temperature and a pH value of 10. The membrane is removed from this solution and is brought into contact with a solution containing 4% of the dye of the formula

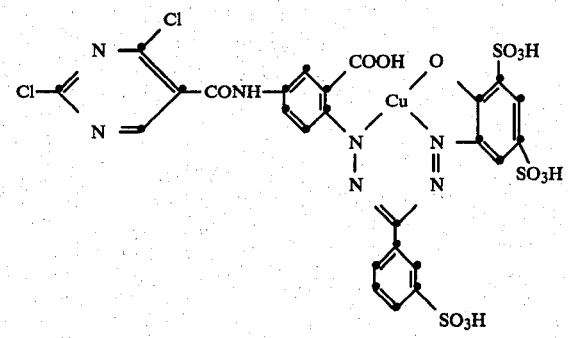

and 10% of sodium chloride, and is kept in this solution for 15 minutes at room temperature. The membrane is then put into a 5% solution of sodium carbonate and is kept there for 30 minutes at room temperature.

It is also possible to use, in the reverse osmosis apparatus used in Examples 1 to 3, any other membrane described in U.S. Pat. No. 4,247,401, U.K. Published Patent Application No. 2,058,798 or European Laid-Open Specification No. 26,399, for example the membranes described in Examples 2–36 of U.K. Published Patent Application No. 2,058,789 or in Examples 1 to 16 of European Laid-Open Specification No. 26,399.

EXAMPLE 4

Solutions, dispersions or filter press cakes of the fluorescent brighteners listed below can be processed by means of reverse osmosis in the same manner as that described in Examples 1 to 3 to give liquid formulations of the appropriate fluorescent brighteners, which are stable on storage and have a low electrolyte content. In the following the fluorescent brightener active substances are shown in every case as the sodium salts. These substances, can, of course, be present in the starting solutions, dispersions and press cakes and also in the finished formulations in the form of free acids and/or other salts, as described earlier in the text. Formulations of the following two fluorescent brighteners:

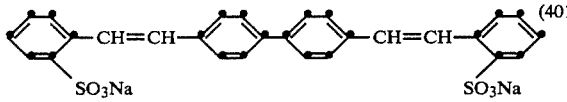

(401)

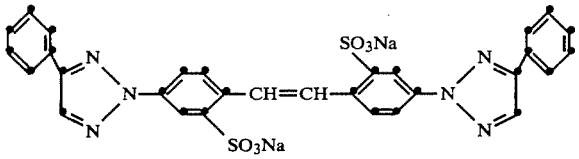

(402)

and also of the following bis-triazinylaminostilbene-2,2'-disulfonic acid fluorescent brighteners shown in Table 1 of the general formula:

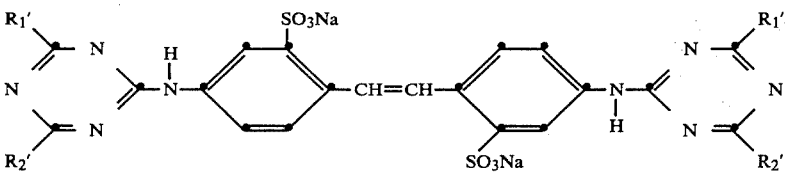

are prepared analogously to Examples 1–3:

| Fluorescent brightener No. | $R_1'$ | $R_2'$ |
|---|---|---|
| 403 | 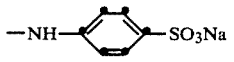 | $-N(CH_2-CH(OH)-CH_3)_2$ |
| 404 | 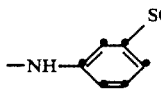 | $-NHCH_2CH_2OH$ |
| 405 | 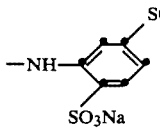 | 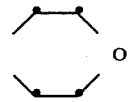 |
| 406 | 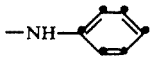 | $-OCH_3$ |
| 407 | $-N(CH_2CHOHCH_3)_2$ | $-N(CH_2CHOHCH_3)_2$ |

-continued

| Fluorescent brightener No. | $R_1'$ | $R_2'$ |
|---|---|---|
| 408 | 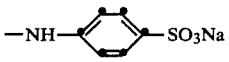 | $-N(CH_2CH_3)_2$ |
| 409 | 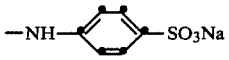 | $-N(CH_3)(CH_2CH_2OH)$ |
| 410 | 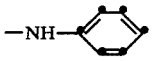 | $-N(CH_3)(CH_2CH_2OH)$ |
| 411 | 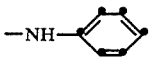 | $-NH(CH_2)_3-O-CH_3$ |
| 412 | 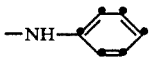 | 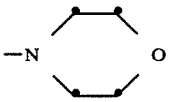 |
| 413 | $-SCH_3$ | 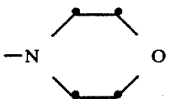 |
| 414 | 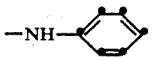 | 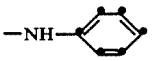 |
| 415 | $-N(CH_2CH_2OH)_2$ | $-OCH_3$ |
| 416 | $-NHCH_2CH_2OCH_2CH_2OH$ | $-OCH_3$ |

EXAMPLE 5

50 g of bleached cellulose (a 10% suspension) are stirred in a metal beaker with 99 ml of water and 1 ml of 10% aluminium sulfate solution and 7.5 ml of a 10% suspension of filler (kaolin) are added after 2 minutes and 0.036 g of a formulation obtained in accordance with Examples 1, 2 or 3 is added after 10 minutes. 2 ml of 5% resin size solution and 1.5 ml of 10% aluminium sulfate solution are added after further intervals of 2 minutes each. The mixture is then made up to 500 ml with water and the suspension is poured into a mixing beaker, made up to 1,000 ml with water and mixed for 2 seconds. The pulp is processed to give sheets of paper, including pressing and drying, in a known manner.

The paper thus obtained has a strong white effect of good fastness to light in all three cases.

What is claimed is:

1. A process for the preparation of a concentrated, storage-stable liquid formulation, which contains an anionic fluorescent brightener, comprising the step of treating a crude aqueous solution or dispersion of an anionic fluorescent brightener containing a sulfo group, with a semipermeable membrane which contains ionic groups and has a pore diameter of 1 to 500 Å, so as to remove salts and synthesis by-products having molecular weights less than 500 and to remove part of the water.

2. A process according to claim 1, wherein the membrane is asymmetrical.

3. A process according to claim 1, wherein the membrane consists of a cellulose acetate basic structure which has been modified by reaction with an ionic compound containing reactive groupings.

4. A process according to claim 1, wherein the membrane consists of a cellulose acetate basic structure which has been modified by reaction with a polyfunctional monomeric compound, a polyfunctional polymer and an ionic compound containing reactive groupings.

5. A process according to claim 1, wherein the membrane consists of a basic structure which contains polyacrylonitrile or a copolymer formed from acrylonitrile and other ethylenically unsaturated monomers and which has been modified by reaction with hydroxylamine and subsequent reaction with a polyfunctional monomeric compound, a polyfunctional polymer and an ionic compound containing reactive groupings.

6. A process according to either of claims 4 or 5, wherein the polyfunctional polymer contains aliphatic or aromatic amino groups or hydroxyl, thiol, isocyanate and/or thioisocyanate groups.

7. A process according to claim 6, wherein the polyfunctional polymer is derived from polyethyleneimine, polyvinyl alcohol, cellulose derivatives or polyvinylaniline.

8. A process according to claim 3, wherein the membrane contains sulfonic acid, carboxylic acid or ammonium groups as the ionic groups.

9. A process according to claim 3, wherein the membrane contains radicals of a water-soluble reactive dye as radicals containing ionic groups.

10. A process according to claim 5, wherein the proportion of acrylonitrile units in the basic structure of the membrane is at least 5% and preferably at least 20%.

11. A process according to claim 10, wherein the basic structure of the membrane contains copolymers of acrylonitrile and vinyl acetate, vinyl ethers, vinylpyridine, vinyl chloride, styrene, butadiene, (meth)acrylic acid, maleic anhydride, 2-aminomethyl methacrylate or allyl compounds, or terpolymers or tetrapolymers based on acrylonitrile.

12. A process according to claim 1, wherein the concentrated aqueous preparation obtained after passage through the semipermeable membrane is used without further treatment as a formulation stable on storage or, if desired, is concentrated further in order to increase the content of fluorescent brightener.

13. A process according to claim 1, wherein the concentrated aqueous preparation obtained after passage through the semipermeable membrane is treated, if desired after further concentration, with one or more formulation assistants and/or further additives.

14. A process according to claim 1 or 13, wherein the formulation assistants employed are one or more substances belonging to the following categories of substance: nonionic or anionic surfactants, organic solubilisers and/or polar organic compounds.

15. A process according to claim 14, wherein the formulation assistants used are hydrophilic organic solvents and/or polar organic compounds, for example lower monohydric, aliphatic and cycloaliphatic alcohols, polyhydric alcohols, ether-alcohols, glycols, polyglycols, glycol ethers, polyglycol ethers, cyclic ethers and esters, nitriles, lactams, lactones, esters of aliphatic hydroxycarboxylic acids, derivatives of 2,5-dihydrothiophene 1,1-dioxide or of tetrahydrothiophene 1,1-dioxide which are unsubstituted or substituted in the $\alpha$-position and/or $\beta$-position by alkyl or hydroxyalkyl, low-molecular aliphatic amides, methylated amides of carbonic acid or phosphoric acid, phosphoric and phosphonic acid esters or amines, in particular alkanolamines, or mixtures of such solvents; and also dimethyl sulfoxide, dimethyl methylphosphonate, dimethyl sulfone, sulfolane, ethylene carbonate, propylene carbonate, urea or substituted ureas or mixtures of such compounds.

16. A process according to claim 14, wherein the formulation assistants employed are nonionic surfactants, such as adducts of alkylene oxides onto higher fatty acids, fatty acid amides, aliphatic alcohols, mercaptans, amines, alkylphenols, alkylthiophenols or phenylphenols, block polymers of ethylene oxide and higher alkylene oxides, nonionic esters of the adducts of alkylene oxides, esters of polyalcohols, N-acylated alkanolamines and adducts thereof with ethylene oxide and reaction products of higher fatty acids with an alkanolamine or anionic surfactants, such as alkylene oxide adducts onto sulfate radicals or other acid radicals, sulfates of N-acylated alkanolamines and sulfated esterified polyhydroxy compounds.

17. A process according to claim 14, wherein the formulation assistants employed are urea, glycols, polyglycols and alkanolamines.

18. A process according to claim 13, wherein antifoaming assistants, acids, bases, water-softening compounds, germicidal substances and/or customary dyeing assistants are added as further additives.

19. A process according to claim 1, wherein the anionic fluorescent brighteners employed are stilbene fluorescent brighteners containing sulfo groups, in particular those of the type of bis-triazinylaminostilbenedisulfonic acids, bis-styrylbiphenyls, bis-styrylbenzenes and bis-triazolylstilbenedisulfonic acids.

20. A process according to claim 19, wherein the fluorescent brighteners employed are those of the formula

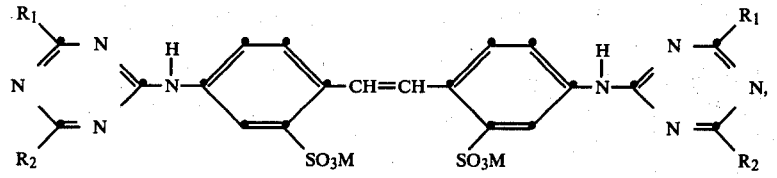

in which M is hydrogen or an alkali metal ion, an alkaline earth metal ion, an ammonium ion or an amine salt ion, and $R_1$ and $R_2$ independently of one another are $NH_2$, $NH—CH_3$ $NH—C_2H_5$, $N(CH_3)_2$, $N(C_2H_5)_2$, $NH—CH_2—CH_2—OH$, $NH—CH_2—CH_2—CH_2—OH$, $N(CH_2—CH_2—OH)_2$, $N(CH_2—CH_2—CH_2OH)_2$, $N(CH_3)(CH_2—CH_2—OH)$, $NH—CH_2—CH_2—O—CH_2—CH_2—OH$, $NH—CH_2—CH_2—CH_2—SO_3M$, OH, $OCH_3$, $OCH(CH_3)_2$, $O—CH_2—CH_2—O—CH_3$,

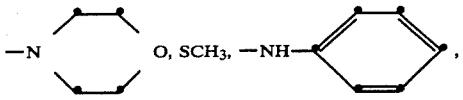

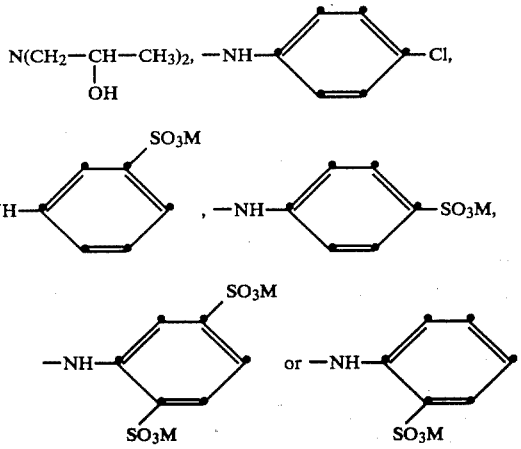

in which M is hydrogen or an alkali metal ion, an alkaline earth metal ion, an ammonium ion or an amine salt ion, of the formula

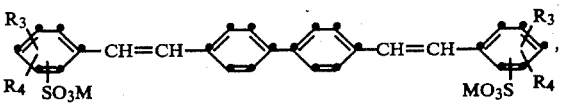

in which $R_3$ is hydrogen, alkyl having 1 to 4 carbon atoms, alkoxy having 1 to 4 carbon atoms, halogen or $SO_3M$, $R_4$ is hydrogen or alkyl having 1 to 4 carbon atoms and M is hydrogen or an alkali metal ion, an alkaline earth metal ion, an ammonium ion or an amine salt ion, or of the formula

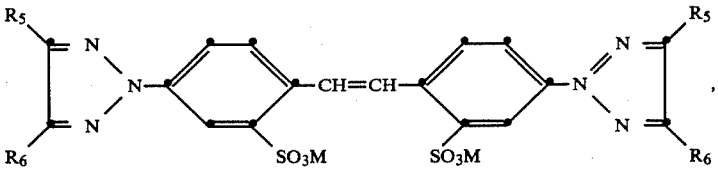

in which M is hydrogen or an alkali metal ion, an alkaline earth metal ion, an ammonium ion or an amine salt ion and $R_5$ and $R_6$ independently of one another are hydrogen, $CH_3$,

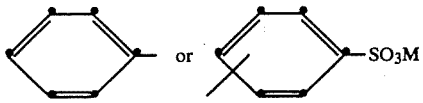

or $R_5$ and $R_6$ together complete a benzene ring.

21. A concentrated liquid formulation of anionic fluorescent brighteners, which is stable on storage and is obtained by the process according to claim 1.

22. A formulation according to claim 21, containing 10–60, preferably 10–40, % by weight of at least one anionic fluorescent brightener, 15–90% by weight of water, 0–50% by weight of formulation assistants and 0–35% by weight of further additives.

23. A formulation according to claim 21 or 22, which contains not more than 1% by weight, preferably not more than 0.5% by weight and, in particular, not more than 0.1% by weight, of inorganic inert salts, in each case based on the total formulation.

* * * * *